US007029384B2

(12) United States Patent
Steimel et al.

(10) Patent No.: US 7,029,384 B2
(45) Date of Patent: Apr. 18, 2006

(54) GRINDING DISK

(75) Inventors: Johannes Steimel, Neidlingen (DE); Rüdiger Graner, Holzmaden (DE)

(73) Assignee: Festool GmbH, Wendlingen (DE)

( * ) Notice: Subject to any disclaimer, the term of this patent is extended or adjusted under 35 U.S.C. 154(b) by 0 days.

(21) Appl. No.: 10/877,041

(22) Filed: Jun. 25, 2004

(65) Prior Publication Data

US 2005/0037701 A1 Feb. 17, 2005

(30) Foreign Application Priority Data

Jun. 27, 2003 (DE) ..... 103 29 826

(51) Int. Cl.
*B24B 23/00* (2006.01)

(52) U.S. Cl. ..... 451/342; 451/359; 451/363

(58) Field of Classification Search ..... 451/342, 451/343, 358, 359, 360, 363, 344; 411/412; 6/413

See application file for complete search history.

(56) References Cited

U.S. PATENT DOCUMENTS 3,623,281 A 11/1971 Moffat
5,349,786 A * 9/1994 Dorrah ..... 451/357
5,496,209 A 3/1996 Gaebe
5,839,948 A * 11/1998 Kronberg ..... 451/353
5,957,646 A 9/1999 Giannuzzi et al.
6,415,935 B1 7/2002 Hins
6,454,639 B1 9/2002 Huber
6,854,942 B1 2/2005 Hargis
6,926,483 B1 8/2005 Hesse et al.
2003/0045214 A1 3/2003 Shepherd

FOREIGN PATENT DOCUMENTS

EP 1 074 347 2/2001

* cited by examiner

*Primary Examiner*—Jacob K. Ackun, Jr.
(74) *Attorney, Agent, or Firm*—Flynn, Thiel, Boutell & Tanis, P.C.

(57) ABSTRACT

A grinding disk (13) for manually held, motor-driven grinders (1) has a centrally arranged fastening recess (15) open at the grinding disk upper side with an internal thread arrangement (16), with which the grinding disk (13) can be screwed onto a connecting part (8), which is arranged on the side of the grinder and is driven for the grinding motion during operation, and which connecting part has a thread section (11) with an external thread arrangement (12), which is associated with the internal thread arrangement (16) of the grinding disk (13). The internal thread arrangement (16) is formed by a multiple thread with at least two thread courses, which are arranged angularly offset to one another. The diameter ratio between the diameter of the internal thread arrangement (16) and the outside diameter of the grinding disk (13) is at least approximately 0.25.

8 Claims, 3 Drawing Sheets

GRINDING DISK

FIELD OF THE INVENTION

The invention relates to a grinding disk for manually held, motor-driven grinders, which grinding disk has a centrally arranged fastening recess open at the grinding disk upper side with an internal thread arrangement so that the grinding disk can be screwed onto a connecting-part, which is arranged on the side of the grinder and is driven for the grinding motion during operation, and which connecting part has a thread section with an external thread arrangement cooperating with the internal thread arrangement of the grinding disk.

BACKGROUND OF THE INVENTION

The internal thread arrangement has in common grinding disks a relatively small diameter and the associated grinder-side-connecting part is formed by a threaded bolt with a corresponding diameter.

The danger exists with these grinding disks that they do not carry out a grinding motion but rotate, so to speak with a wobble and thus unevenly. This can influence the work result.

SUMMARY OF THE INVENTION

The basic purpose of the present invention is therefore to produce a grinding disk of the above-identified type, which rotates as flat as possible during operation.

This purpose is attained according to the invention in such a manner that the internal thread arrangement is formed by a multiple thread with at least two thread courses, which are arranged angularly offset to one another, and that the diameter ratio between the diameter of the internal thread arrangement and the outside diameter of the grinding disk is at least approximately 0.25.

The internal thread arrangement has in the inventive grinding disk, with reference to the outside diameter of the grinding disk, a minimum diameter, starting from which the grinding motion of the grinding disk, as tests have shown, runs at least essentially true.

Furthermore it is possible for a multiple thread to transmit a larger torque in comparison to a single thread due to its greater pitch with the same material stress. It is therefore possible to tighten the grinding disk more or to again easily unscrew same with an equally strong tightening torque as with a single thread.

Advantageous developments of the invention are disclosed in the subclaims.

BRIEF DESCRIPTION OF THE DRAWINGS

One exemplary embodiment of the invention will be discussed in detail hereinafter in connection with the drawings, in which.

DETAILED DESCRIPTION

Figure 1:
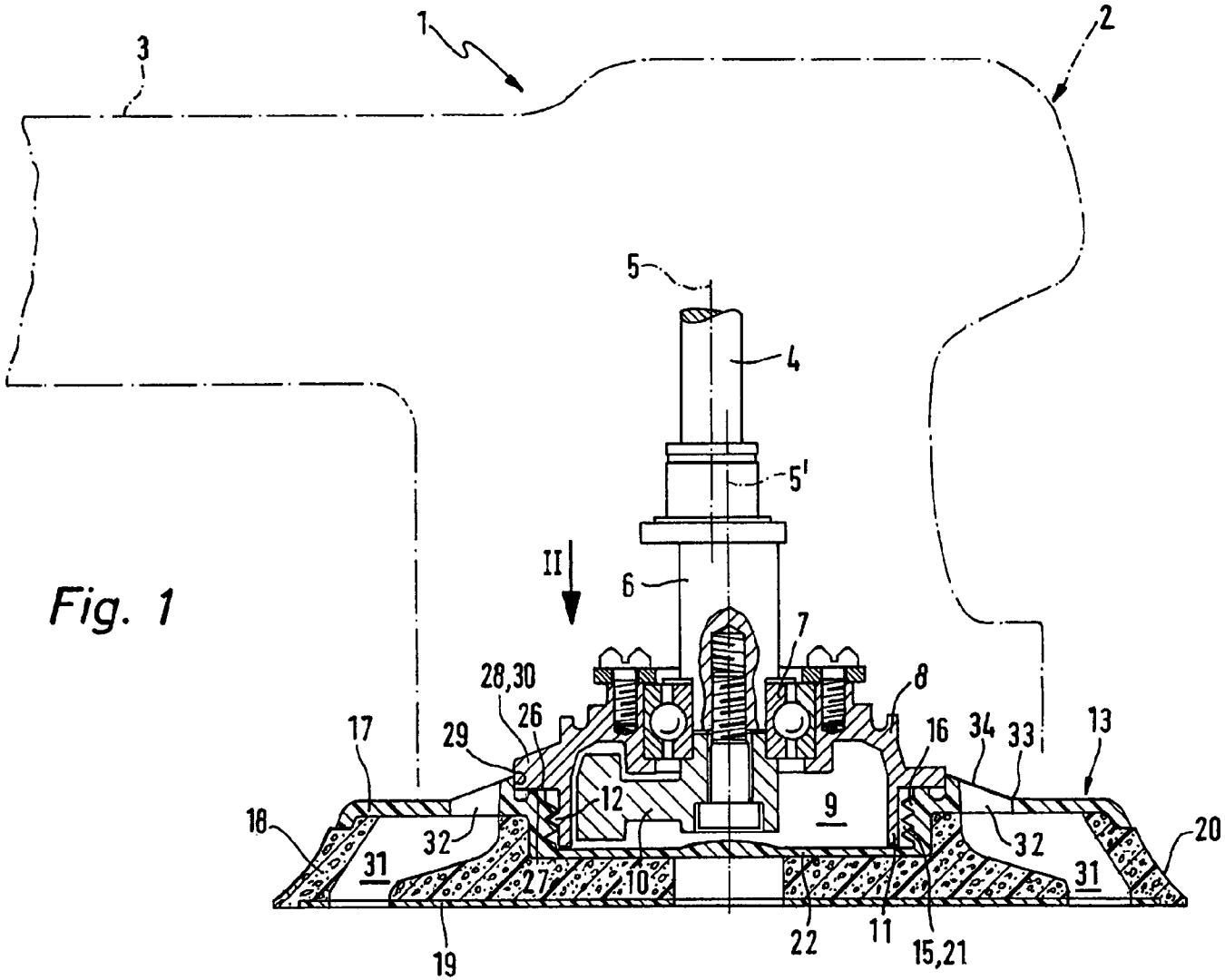
FIG. 1 is a longitudinal cross-sectional view of a portable grinder with an inventive grinding disk, whereby the contour of the grinder housing is indicated by dash-dotted lines.

The motor-driven portable grinder 1 illustrated in FIG. 1 is an eccentric disk grinder and has a grinder head 2, which is followed by a motor housing 3, in which a drive motor (not illustrated) is housed. The motor housing 3 is thereby arranged and formed in such a manner that it can serve as a handle. The grinder head 2 can be held with the other hand and downwardly against a workpiece to be ground.

The grinder head 2 houses a work unit which can be driven from the drive motor, and which has a drive shaft 4, which extends at a right angle with respect to the motor shaft and is driven through a guide gearing (not illustrated) from said motor shaft. A crankpin 6 extending parallel to the drive shaft 4 is added at the lower end of said drive shaft 4 eccentrically with respect to its shaft-axis line 5. The pin-axis line of the crankpin 6, which pin-axis line is eccentric with respect to the shaft-axis line 5, is identified with the reference numeral 5'.

A connecting part 8 is supported rotatably through a pivot bearing 7 on the crankpin 6, which connecting part carries out a circular motion about the shaft-axis line 5 during operation. The connecting part 8 has a downwardly open cavity 9, in which is arranged an imbalance-compensating body 10, which is connected fixed against rotation to the crankpin 6 and projects from same toward the side of the shaft-axis line 5 so that an altogether balanced arrangement results.

The connecting part 8 forms a downwardly projecting thread section 11 with an external thread arrangement 12 so that a grinding disk 13 can be screwed onto the thread section 11. The grinding disk 13 has a centrally arranged fastening recess 15, which is open at the grinding disk upper side 14, with an internal thread arrangement 16, which cooperates with the external thread arrangement 12 of the connecting part 8 so that the grinding disk 13 can be screwed with its internal thread arrangement 16 releasably onto the external thread arrangement 12 of the connecting part 8. The grinding disk 13 carries out a grinding motion corresponding to the circular motion of the connecting part 8, in the screwed-on state during operation.

The grinding disk 13 has a circular design. It is formed in the illustrated case out of a grinding disk upper part 17 of a rigid material, in particular a plastic material, and out of a grinding disk bottom part 18 of a flexible material, in particular foam plastic, which grinding disk bottom part 18 is attached at the bottom to the upper part 17, whereby a grinding-blade-like grinding means can be exchangeably fastened on the underside of the grinding disk bottom part 18, with which grinding means the grinding operation of the respective workpiece is carried out. The grinding means can be fastened by means of Velcro. A Velcro layer 19 is for this purpose arranged on the underside of the grinding disk bottom part 18. The grinding means (not illustrated) has a Velcro layer cooperating with the Velcro layer 19.

The grinding disk upper part 17 covers the grinding disk bottom part 18 in a plate-like manner. The bottom part 18 projects thereby with its periphery beyond the upper part 17, whereby the bottom part 18, starting out from the upper part 17, enlarges slowly downwardly so that an edge area 20 of the bottom part 17 results, which edge area is not covered by the upper part 18 and extends inclined downwardly outwardly.

The fastening recess 15 is formed by a can-like recessed portion 21 of the grinding disk upper part 17, which recessed portion extends into the grinding disk bottom part 18, and on the edge of which is constructed the internal thread arrangement 16. The recessed portion 21 is closed off downwardly by a bottom wall 22.

Figure 2:
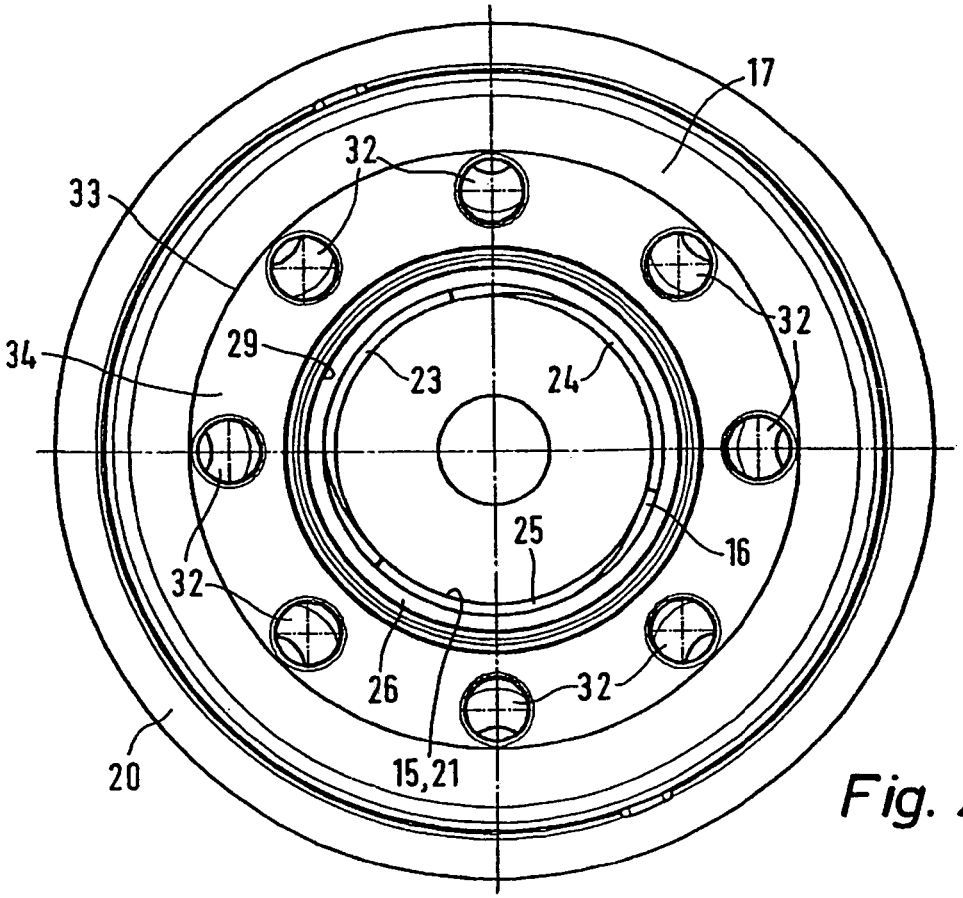
FIG. 2 is a top view from above according to the arrow II of FIGS. 1 and 4 of the grinding disk of the arrangement according to FIG. 1 in an isolated state.
Figure 3:
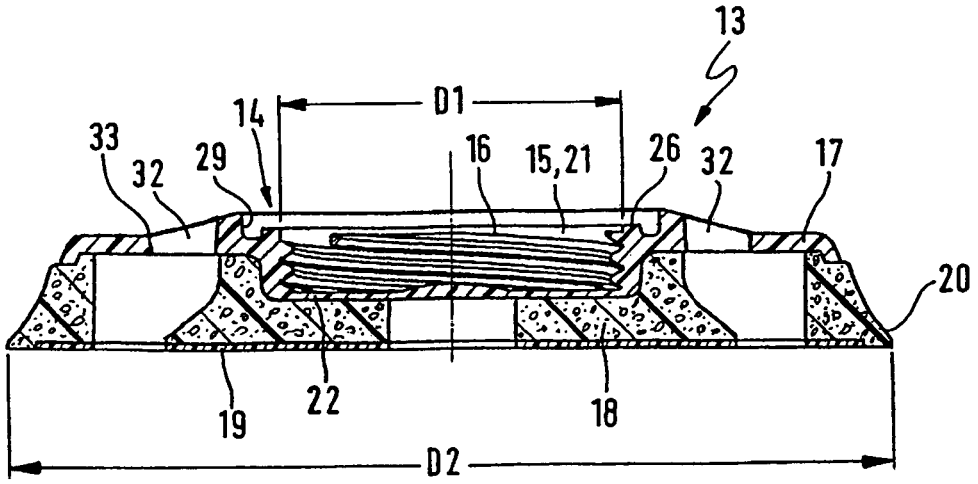
FIG. 3 is a cross-section corresponding to FIG. 1 of the grinding disk according to FIG. 2.

The internal thread arrangement 16 is formed by a multiple thread with at least two threads, which are arranged angularly offset to one another. Advantageously it is a three-course thread with three thread courses 23, 24, 25, the beginning of which are visible in the top view according to FIG. 2. The thread courses 23, 24, 25 are each offset at 120° to one another and engage one another.

Figure 4:
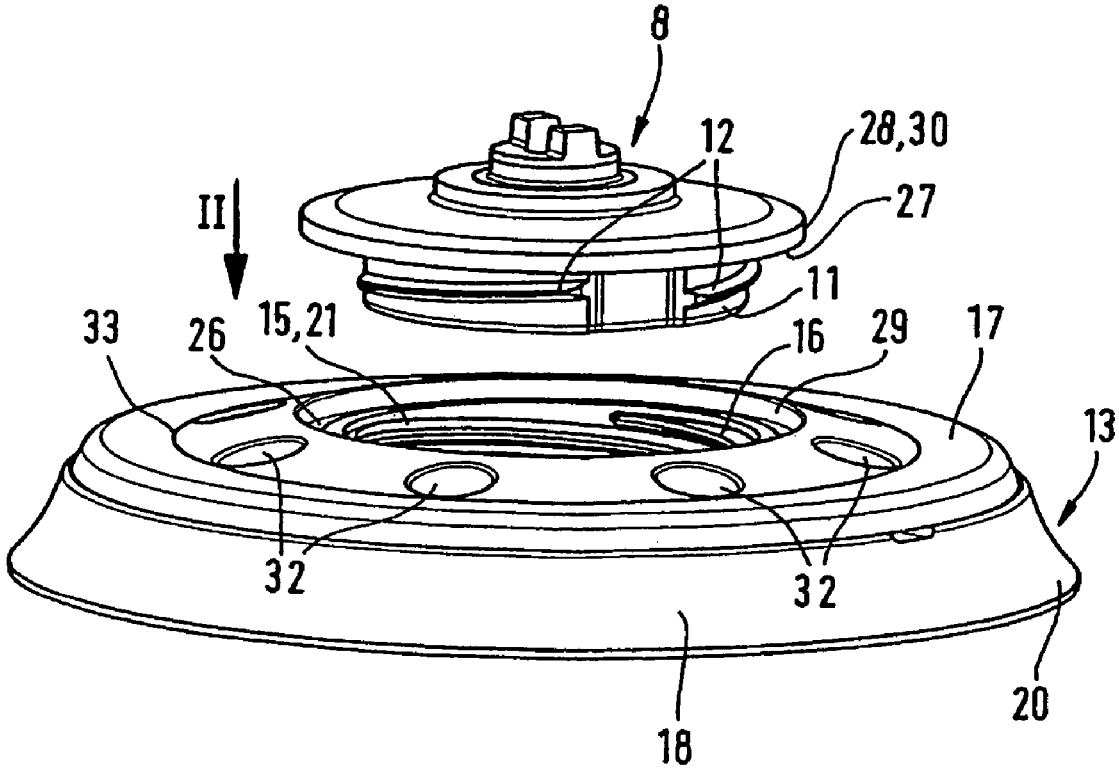
FIG. 4 is an oblique view of the same grinding disk and of a connecting part on the grinder side used to fasten the grinding disk in a state away from the grinder, whereby the grinding disk is unscrewed from the connecting part or has not yet been screwed onto said connecting part.

The external thread arrangement 12 of the connecting part 8 is accordingly designed with multiple threads. FIG. 4 shows two of the three thread courses of the external thread arrangement 12. FIG. 4 furthermore shows that the thread courses of the external thread arrangement 12 extend over a circumference angle, which is not greater than 120°. The thread section 11 of the connecting part 8 has accordingly in axial direction a correspondingly short length. Whereas the fastening recess 15 of the grinding disk 13 has a greater depth, however, can also be kept small in axial direction.

Furthermore it is provided that the diameter ratio between the diameter D1 of the internal thread arrangement 16 and the outside diameter D2 of the grinding disk 13 is at least approximately 0.25. The outside diameter D2 of the grinding disk 13 refers to its nominal diameter, which means its largest diameter, which occurs in the exemplary embodiment on the underside of the grinding disk bottom part 18. The diameter D1 of the internal thread arrangement 16 is thus at least one fourth of the outside diameter D2 of the grinding disk 13.

The mentioned diameter ratio lies advantageously in the range between approximately 0.25 to 0.5, whereby the range between approximately 0.3 and 0.4 is particularly advantageous.

The diameter D1 of the internal thread arrangement 16 and accordingly also the diameter of the external thread arrangement 12 of the grinder-side connecting part 8 are thus, referred to the outside diameter D2 of the grinding disk 13, relatively large. This results, when the grinding disk 13 is screwed tightly, not only in a stable and secure hold but most of all also in a grinding motion, which takes place practically precisely according to plan.

The grinding disk 13 has on its upper side a bearing surface 26 of an annular design, which extends around the port of the fastening recess 15 and rests, when the grinding disk 13 is screwed on, on a grinder-side opposite surface 27. During its screwing on, the grinding disk 13 is braced against this opposite surface 27. The opposite surface 26 is formed by the underside of an annular flange 28 of the connecting part 8, which projects radially outwardly at the upper end of the thread section 11.

The grinding disk 13 forms furthermore on its upper side a plug recess, which is concentric with respect to the fastening recess 15 and has a larger diameter than the bearing surface 26, and into which extends a grinder-side ring portion 30 so that a centering takes place. The ring portion 30 is in the exemplary embodiment formed by the annular flange 28 of the connecting part 8. The bearing surface 26 forms the bottom of this plug recess 29.

The grinding disk 13 has through openings 31, which end on the one side at the underside and on the other side at the upper side of said grinding disk 13. The upper-side ports 32 of the through openings 31 are thereby arranged radially outside of the fastening recess 15 and are thereby distributed around the fastening recess 15. These through openings 31 are used to suck off the dust created during the grinding operation. A suction current is for this purpose produced in the usual manner, which suction current carries along the grinding dust sucked off from the workpiece. Such dust-suction devices are common so that a description regarding these is not necessary.

The drawings furthermore show that the upper-side ports 32 of the through openings 31 are arranged in radial direction at least essentially within the circumference 33, which extends centrally between the internal thread arrangement 16 and the outer, circumference of the grinding disk 13. The annular surface 34 of the grinding disk 13, which annular surface starts from the mentioned circumference 33 radially inwardly and houses the upper-side ports 32 of the through openings 31, is in the exemplary embodiment slightly conically adjusted.

In conclusion it is pointed out that the described grinding disk is not only suited for eccentric disk grinders but also for grinders with a rotating grinding disk or also for those grinders where the circulatory motion is superposed by a rotational motion.

The invention claimed is:

1. A grinding disk for manually held, motor-driven grinders, which grinding disk has a centrally arranged fastening recess open at the grinding disk upper side with an internal thread arrangement so that the grinding disk can be screwed onto a connecting part, which is arranged on the side of the grinder and is driven for the grinding motion during operation, and which connecting part has a thread section with an external thread arrangement cooperating with the internal thread arrangement of the grinding disk, wherein the internal thread arrangement is formed by a multiple thread with at least two thread courses, which are arranged angularly offset to one another, and that the diameter ratio between the diameter of the internal thread arrangement and the outside diameter of the grinding disk is at least approximately 0.25.

2. The grinding disk according to claim 1, wherein the internal thread arrangement is formed by a threecourse thread.

3. The grinding disk according to claim 1, wherein the diameter ratio between the diameter of the internal thread arrangement and the outside diameter of the grinding disk lies in the range between approximately 0.25 to 0.5.

4. The grinding disk according to claim 1, wherein the grinding disk has a bearing surface of an annular design on its upper side, which bearing surface is arranged extending around the port of the fastening recess and rests during screwing on of the grinding disk on a grinder-side opposite surface.

5. The grinding disk according to claim 4, wherein the grinding disk forms on its upper side a plug recess, which is concentric with respect to the fastening recess and has a larger diameter than the bearing surface, for the centering engagement of a grinderside ring portion.

6. The grinding disk according to claim 1, wherein it has through openings for sucking off the dust created during grinding, which end on the one side at the underside and on the other side at the upper side of the grinding disk, whereby the upperside ports are arranged radially outside of the fastening recess circularly distributed around same.

7. The grinding disk according to claim 6, wherein the upperside ports are arranged in radial direction at least essentially within the circumference, which extends centrally between the internal thread arrangement and the outer circumference of the grinding disk.

8. The grinding disk according to claim 1, wherein the diameter ratio between the diameter of the internal thread arrangement and the outside diameter of the grinding disk lies in the range between approximately 0.3 to 0.4.

* * * * *